US009121265B2

(12) United States Patent
Myers et al.

(10) Patent No.: US 9,121,265 B2
(45) Date of Patent: Sep. 1, 2015

(54) FULL FLOW GUN SYSTEM FOR MONOBORE COMPLETIONS

(75) Inventors: William D. Myers, Spring, TX (US); Stephen N. Zuklic, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 301 days.

(21) Appl. No.: 13/587,354

(22) Filed: Aug. 16, 2012

(65) Prior Publication Data

US 2013/0233554 A1 Sep. 12, 2013

Related U.S. Application Data

(60) Provisional application No. 61/525,138, filed on Aug. 18, 2011.

(51) Int. Cl.
*E21B 43/11* (2006.01)
*E21B 43/116* (2006.01)

(52) U.S. Cl.
CPC ..... *E21B 43/11* (2013.01); *E21B 43/116* (2013.01)

(58) Field of Classification Search
CPC ..... E21B 43/11; E21B 43/116; E21B 43/119
USPC ..... 166/297, 55, 369
See application file for complete search history.

(56) References Cited

U.S. PATENT DOCUMENTS

| | | | | |
|---|---|---|---|---|
| 5,346,007 | A * | 9/1994 | Dillon et al. | 166/278 |
| 5,704,426 | A * | 1/1998 | Rytlewski et al. | 166/297 |
| 5,829,538 | A | 11/1998 | Wesson et al. | |
| 6,062,310 | A | 5/2000 | Wesson et al. | |
| 6,152,224 | A | 11/2000 | French | |
| 6,220,355 | B1 | 4/2001 | French | |
| 6,230,808 | B1 | 5/2001 | French et al. | |
| 6,286,594 | B1 | 9/2001 | French | |
| 6,289,991 | B1 | 9/2001 | French | |
| 2002/0053434 | A1 * | 5/2002 | Chen et al. | 166/297 |
| 2007/0181304 | A1 * | 8/2007 | Rankin et al. | 166/297 |
| 2008/0066912 | A1 * | 3/2008 | Freyer et al. | 166/297 |
| 2009/0159285 | A1 * | 6/2009 | Goodman | 166/297 |

FOREIGN PATENT DOCUMENTS

GB 2332920 A 7/1999

* cited by examiner

*Primary Examiner* — Brad Harcourt
(74) *Attorney, Agent, or Firm* — Steve Rosenblatt

(57) ABSTRACT

A perforating gun assembly for a monobore application eliminates a full bore isolation valve or other component that has a limiting internal or external dimension and is designed to remain in position after firing. The assembly is run into the hole on a string with a running tool and left in position with the string and the running tool removed. Pressure pulses communicate with a detonation control system to open a poppet to pressurize a chamber with a firing head. It should be noted that other types firing heads can also be utilized to initiate detonation in the system. Detonation clears the gun internals for flow and opens a gun valve that has no reduction in drift dimension as compared to the gun internal path after detonation. Production takes place through and around the gun. The top of the gun can be entered for future intervention work.

18 Claims, 1 Drawing Sheet

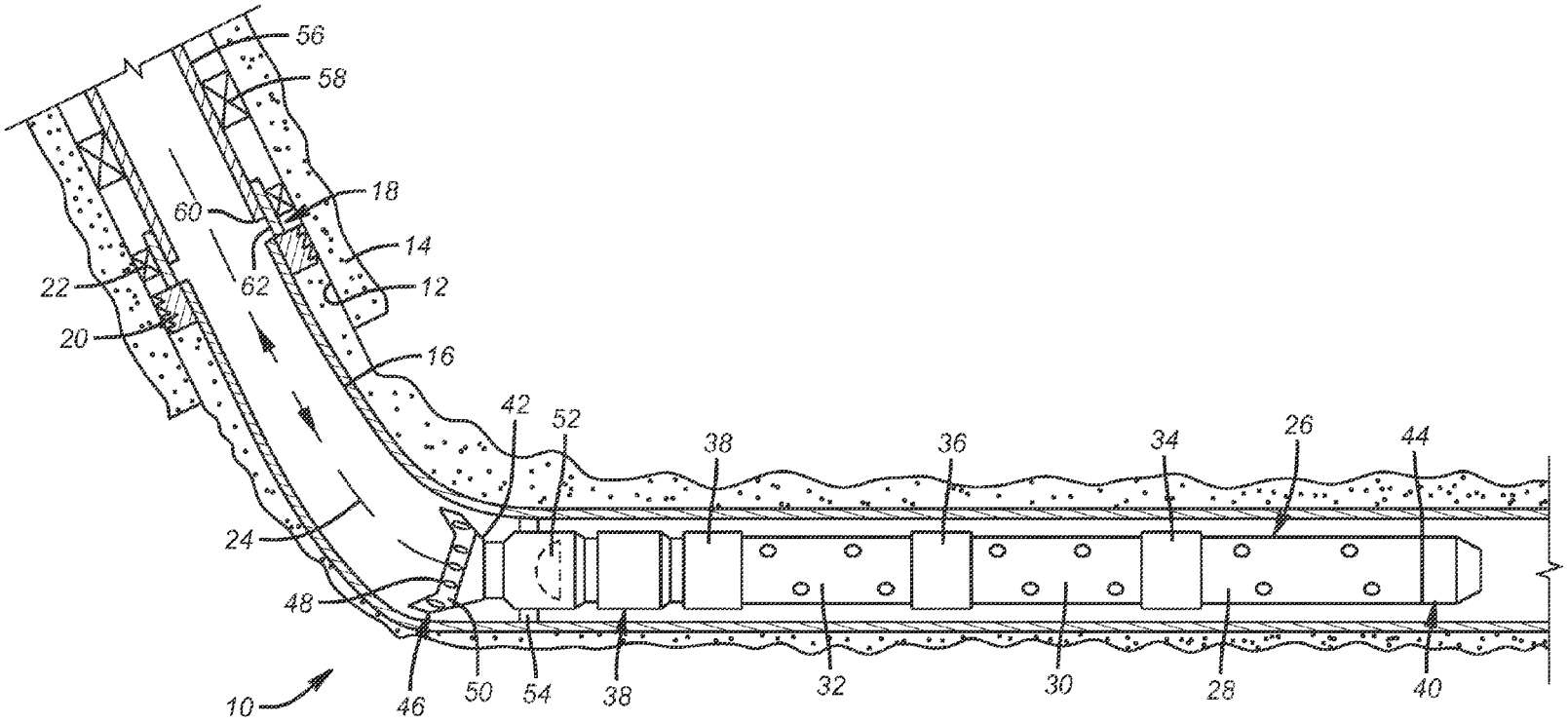
56
58
18
14
12
16
42
52
38
36
34
26
44
40
28
30
32
38
54
50
46
48
24
10
62
60
22
20

FULL FLOW GUN SYSTEM FOR MONOBORE COMPLETIONS

CROSS REFERENCE TO RELATED APPLICATION

This application is claims priority from U.S. Provisional Patent Application Ser. No. 61/525,138, filed on Aug. 18, 2011, the disclosure of which is incorporated herein by reference in its entirety.

FIELD OF THE INVENTION

The field of the invention is perforating guns and more particularly those that can allow full flow through the gun body after detonation without restriction that comes with suspending perforating guns from the production packer assembly.

BACKGROUND OF THE INVENTION

In the past, guns that had flow restrictions through them after detonation had to be pulled from the well to avoid having the flow restriction. To do that the well needed to be killed which in certain formations could diminish future production from that formation. Previous inventions of flow-through guns allow passage of production fluids through the inside diameter of the guns, providing a means for leaving the guns in the well and eliminating the need to kill the well. These systems are installed in the well as part of the completion assembly, typically including a packer, tubing, and accessories set inside the casing, and therefore having an inside diameter smaller than the casing itself. Monobore completions have a single inside diameter in the wellbore to reduce flow restriction once the well was put into production. Suspending the guns within the monobore creates a restriction through which the production fluids must flow and thereby reduces or defeats the advantage of having a monobore.

The present invention addresses this need in a monobore perforating application including vertical, deviated or horizontal applications. This flow through gun assembly gun can remain in position, provide flow-through access within the spent perforating gun assembly, and the top of it can be entered for future interventions. Production flow can be through and around the gun to minimally affect production rate.

SUMMARY OF THE INVENTION

A perforating gun assembly for a monobore application eliminates a full bore isolation valve or other component that has a limiting internal or external dimension and is designed to remain in position after firing. The assembly is run into the hole on a string with a running tool and left in position with the string and the running tool removed. Pressure pulses communicate with a detonation control system to open a poppet to pressurize a chamber with a firing head. It should be noted that other types firing heads can also be utilized to initiate detonation in the system. Detonation clears the gun internals for flow and opens a gun valve that has no reduction in drift dimension as compared to the gun internal path after detonation. Production takes place through and around the gun. The top of the gun can be entered for future intervention work throughout the entire gun assembly. A hanger system can be used with the gun for vertical or deviated completions. Swelling packers can be used between gun sections for zonal isolation.

Other embodiments include using swelling materials along the entire length of the gun assembly to provide wellbore support or filtration medium for produced fluids. Those skilled in the art will recognize the benefits of such a system and the listed additional embodiments as being useful for many applications, not only for monobore style completions.

BRIEF DESCRIPTION OF THE DRAWING

The FIGURE illustrates the gun of the present invention in position in a horizontal monobore location before the gun is fired.

DETAILED DESCRIPTION OF THE PREFERRED EMBODIMENT

Referring to the FIGURE, a horizontal wellbore 10 has a casing 12 that is cemented at 14. A production liner 16 is hung off the casing 12 using a liner hanger 18 that has slips 20 and a seal 22. Dashed line 24 and the arrows that are on it schematically represent a running string and running tool that delivered and released from the gun assembly 26. Gun 26 has sections 28, 30 and 32 that schematically appear in the FIG. but can be in different zones in a fairly long assembly of the gun 26. Isolators such as 34, 36 and 38 can be used. Preferably they are swelling packers that react to well fluids or added fluids to swell and seal off the liner 16 at the desired locations to isolate the various zones. Two or more zones are contemplated as well as a single zone where the packers 34, 36 and 38 can be eliminated.

The schematically represented firing head assembly 38 includes a chamber that houses the firing pin with a poppet valve that opens for pressure access of well fluids into the chamber. A processor is included that responds to a coded signal of pressure pulses through the well fluid reaching a pressure sensor to selectively open the poppet and actuate the firing pin to set the gun 26 off. The detonation also creates large internal pressure in the gun 26 that does several things. The end plug 40 blows out. The internal components of the gun 26 are consumed by the explosion leaving a clear full path between ends 42 and 44 of the gun 26. A fluted scoop head 46 allows entering into the top of the gun for any subsequent interventions through the gun. The flutes 48 provide flow channels 50 among them for ultimate production flow from the formation that can flow through the now empty inside gun 26 or around the outside of the gun through the channels 50. Finally, the setting off of the gun 26 automatically forces open valve 52 associated with the gun 26 for a continuation of an open passage between ends 42 and 44 where the drift diameter is not reduced. While an anchor 54 is shown in the FIGURE, it is only needed in deviated or vertical wellbores to hold the gun 26 in position. This anchor can be positioned at either end of the perforating gun assembly. In the horizontal bore that is illustrated in the FIGURE, an anchor is not necessary to support the gun until it is fired. Apart from this, to the extent one or more of the isolators 34, 36 and 38 set before the gun is fired, then an anchor such as 54 would also be optional. However, with an anchor 54 the gun can be positioned, supported and fired without waiting for swelling packers to swell to the point of holding the weight of gun 26 so that the gun 26 can be released from the running tool and running string 24 as soon as anchor 54 is set.

For production a production string 56 is run in with an external packer 58. The lower end 60 is sealingly tagged into a polished bore receptacle 62 near the top of the liner 16.

The above description is illustrative of the preferred embodiment and many modifications may be made by those skilled in the art without departing from the invention whose scope is to be determined from the literal and equivalent scope of the claims below.

We claim:

1. A perforating method for a borehole to a subterranean location, comprising:

locating a perforating gun assembly at a predetermined location with a running string;

firing said assembly when supported by said running string;

releasing said running string from supporting said gun assembly after said firing, running in a production string with an isolation device extendable onto a borehole tubular at a spaced location from said predetermined location of said gun assembly;

producing fluids through, around and beyond a length of said assembly from at least one surrounding formation with said assembly remaining in place after said firing.

2. The method of claim 1, comprising:

blowing out an end plug from said assembly due to said firing.

3. The method of claim 2, comprising:

providing a re-entry guide with external flutes at a connection location for said running string.

4. The method of claim 3, comprising:

defining exterior flow channels with said flutes;

directing fluid flowing outside said assembly through said channels.

5. The method of claim 1, comprising:

providing a gun valve in said assembly which in the open position upon said firing does not reduce drift dimension through said assembly.

6. The method of claim 5, comprising:

locating said assembly in a monobore borehole.

7. The method of claim 1, comprising:

setting an anchor for said assembly before said firing.

8. The method of claim 7, comprising:

providing at least one external isolator for said borehole mounted to said assembly.

9. The method of claim 8, comprising:

allowing said isolator to swell to block said borehole.

10. The method of claim 9, comprising:

firing said assembly with said anchor set before said isolator swells to seal against said borehole.

11. The method of claim 8, comprising:

locating said assembly in a monobore borehole.

12. The method of claim 7, comprising:

using a running string to initially position said assembly for said firing;

releasing said running string after setting said anchor and before said firing.

13. The method of claim 12, comprising:

using pressure pulses to accomplish said firing.

14. The method of claim 1, comprising:

providing at least one external isolator for said borehole mounted to said assembly.

15. The method of claim 14, comprising:

allowing said isolator to swell to block said borehole.

16. The method of claim 14, comprising:

providing a plurality of spaced apart isolators on said assembly.

17. The method of claim 1, comprising:

locating said assembly in a monobore borehole.

18. The method of claim 1, comprising:

using pressure pulses to accomplish said firing.

* * * * *